US010787359B1

(12) United States Patent
Gaskill

(10) Patent No.: US 10,787,359 B1
(45) Date of Patent: Sep. 29, 2020

(54) FUEL NOZZLE RETAINING APPARATUS

(71) Applicant: Lori Gaskill, Pahrump, NV (US)

(72) Inventor: Lori Gaskill, Pahrump, NV (US)

( * ) Notice: Subject to any disclaimer, the term of this patent is extended or adjusted under 35 U.S.C. 154(b) by 0 days.

(21) Appl. No.: 16/436,712

(22) Filed: Jun. 10, 2019

(51) Int. Cl.
*B67D 7/42* (2010.01)

(52) U.S. Cl.
CPC ..... *B67D 7/42* (2013.01)

(58) Field of Classification Search
CPC . B67D 7/42; B67D 7/0211; B67D 2007/0421
USPC ..... 141/392
See application file for complete search history.

(56) References Cited

U.S. PATENT DOCUMENTS 3,291,165 A * 12/1966 Fraylick ..... B67D 7/421 141/286
4,537,437 A * 8/1985 Buccola ..... B60K 15/04 141/311 R
5,236,023 A 8/1993 Mohr
5,385,182 A 1/1995 Dyer
5,692,547 A 12/1997 Lehr
7,581,570 B1 * 9/2009 Lamke ..... B67D 7/42 141/1
2019/0284041 A1 * 9/2019 Hattum ..... B60P 3/2265

* cited by examiner

*Primary Examiner* — Timothy L Maust

(57) ABSTRACT

A fuel nozzle retaining apparatus for securing a fuel nozzle in place on a freight truck with side fairings includes a retainer body having a bottom edge with a notch extending towards a top edge and configured to receive a fuel nozzle of a gas pump. The retainer body is configured to engage a fairing of a freight truck within a fuel cutout of the fairing. A body width of the retainer body from the left edge to the right edge is configured to be greater than a cutout width of the fuel cutout, and a thickness of the retainer body to conform to an orthogonal distance between an inner face of the fairing and a nozzle head of the fuel nozzle when engaged within a fuel tank aperture of the truck. The apparatus thus retains the fuel nozzle within the fuel tank aperture.

8 Claims, 4 Drawing Sheets

FUEL NOZZLE RETAINING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to fueling devices and more particularly pertains to a new fueling device for securing a fuel nozzle in place on a freight truck with side fairings.

BRIEF SUMMARY OF THE INVENTION

An embodiment of the disclosure meets the needs presented above by generally comprising a retainer body having a front side separated from a back side, a top edge separated from a bottom edge, and a left edge separated from a right edge. The bottom edge has a notch having a left face, a top face, and a right face. The notch extends towards the top edge of the retainer body and is configured to receive a fuel nozzle of a gas pump. The retainer body is configured to engage a fairing of a freight truck within a fuel cutout of the fairing. A width of the retainer body from the left edge to the right edge is configured to be greater than a width of the fuel cutout, and a thickness of the retainer body to conform to an orthogonal distance between an inner face of the fairing and a nozzle head of the fuel nozzle when engaged within a fuel tank aperture of the truck. The apparatus thus retains the fuel nozzle within the fuel tank aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
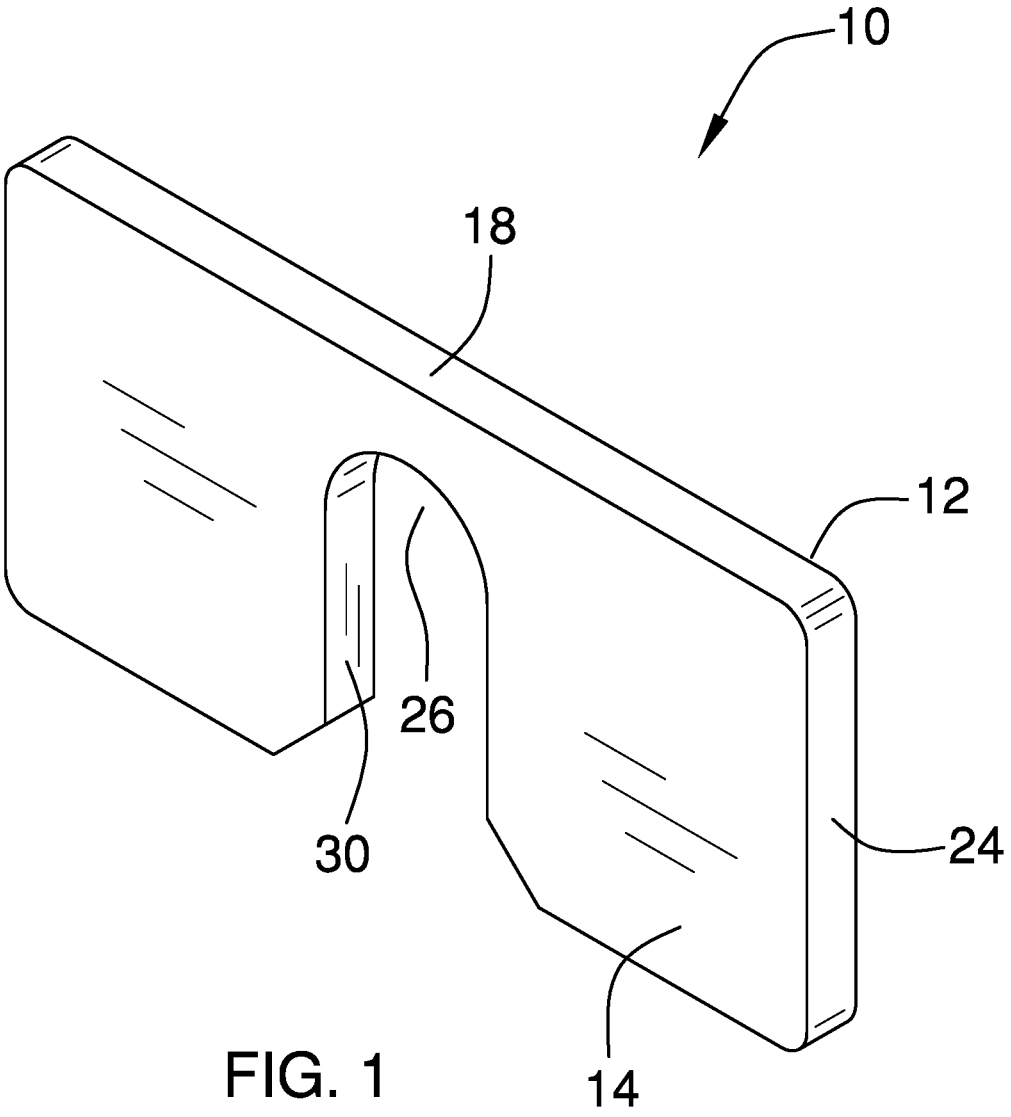
FIG. 1 is an isometric view of a fuel nozzle retaining apparatus according to an embodiment of the disclosure.
Figure 2:
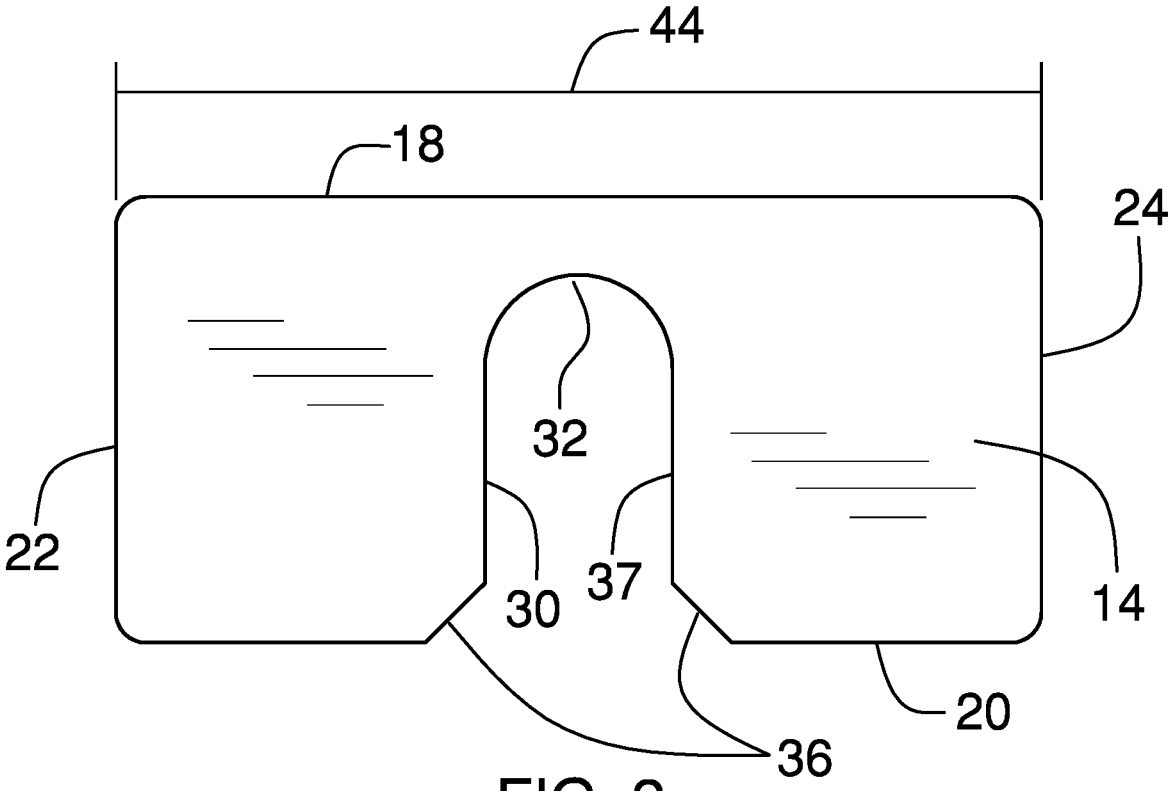
FIG. 2 is a front elevation view of an embodiment of the disclosure.
Figure 3:
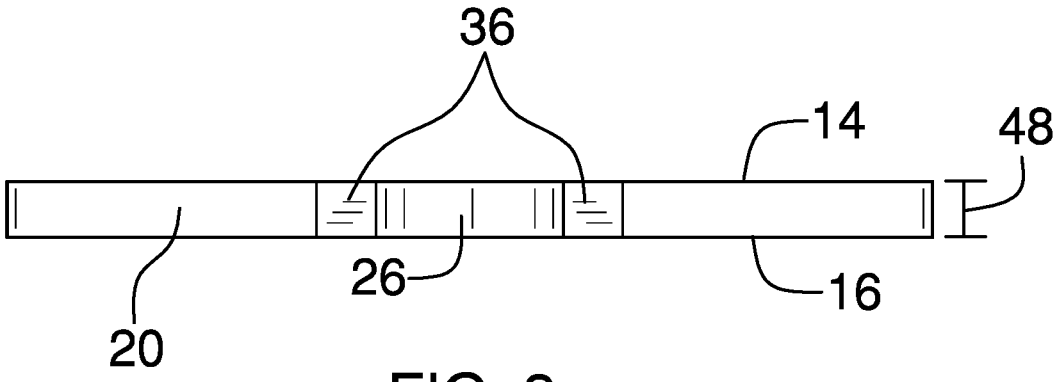
FIG. 3 is a bottom plan view of an embodiment of the disclosure.
Figure 4:
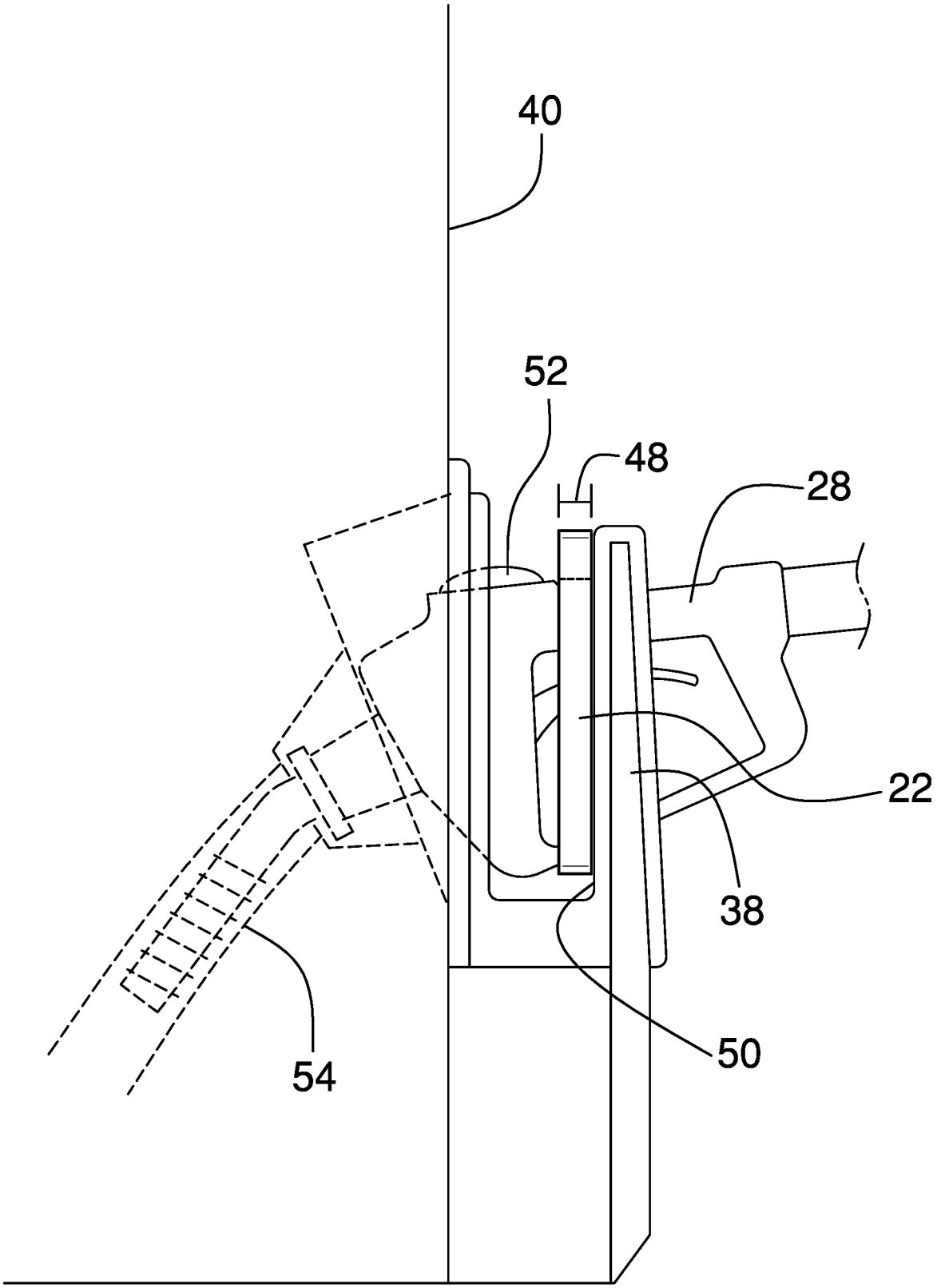
FIG. 4 is an in-use view of an embodiment of the disclosure.
Figure 5:
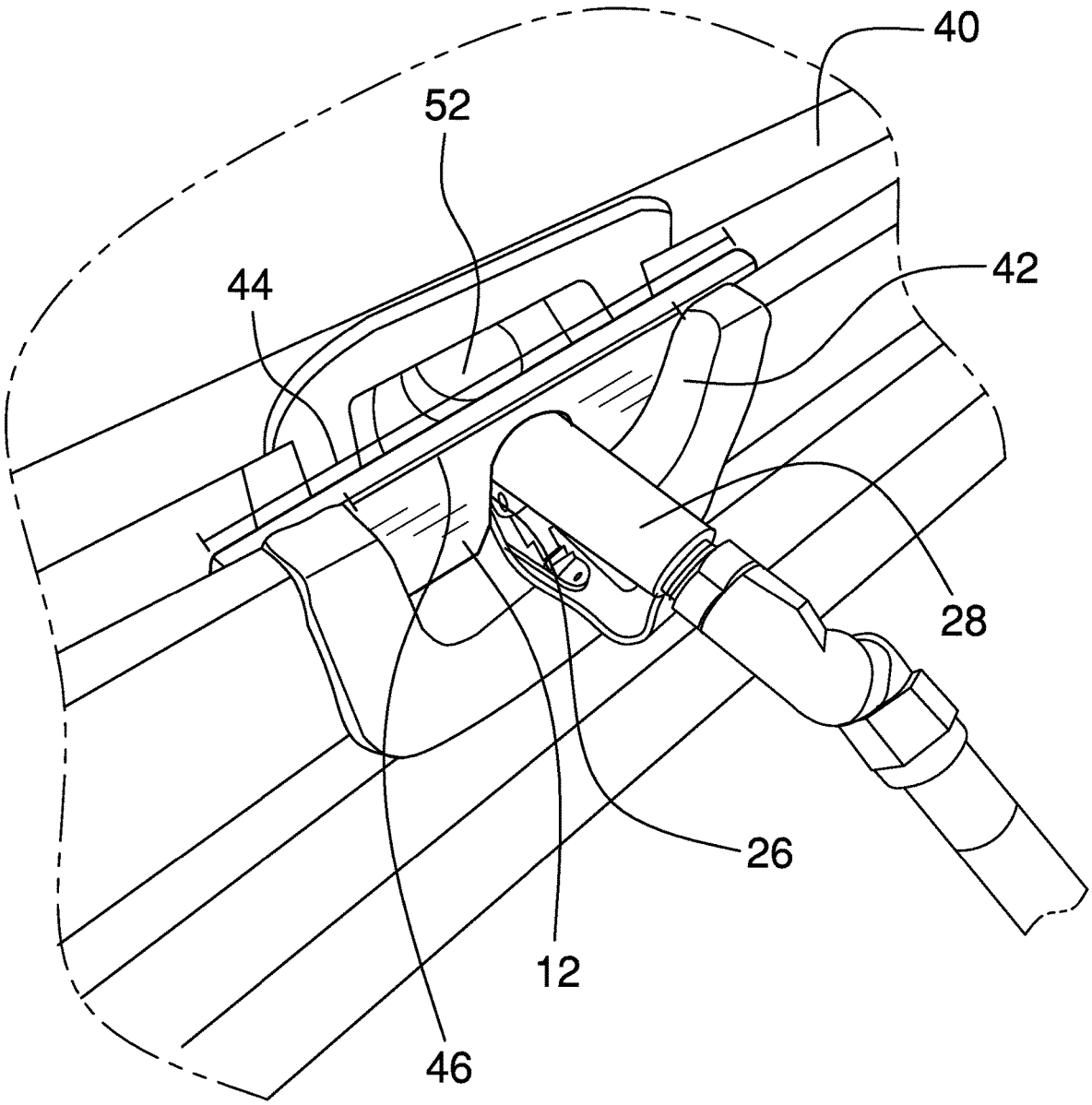
FIG. 5 is an in-use view of an embodiment of the disclosure.

With reference now to the drawings, and in particular to FIGS. 1 through 5 thereof, a new fueling device embodying the principles and concepts of an embodiment of the disclosure and generally designated by the reference numeral 10 will be described.

As best illustrated in FIGS. 1 through 5, the fuel nozzle retaining apparatus 10 generally comprises a retainer body 12 having a front side 14 separated from a back side 16, a top edge 18 separated from a bottom edge 20, and a left edge 22 separated from a right edge 24. The retainer body 12 may have rounded corners to prevent accidental injury. The bottom edge 20 a notch 26 extending towards the top edge 18 of the retainer body and configured to receive a fuel nozzle 28 of a gas pump. The notch 26 has a left face 30, a top face 32, and a right face 34. The top face 32 may be semicircular to best accommodate the fuel nozzle 28. The retainer body 12 is rectangular excepting the notch 26. The left face 32 and the right face 34 of the notch are parallel and each lies in a plane parallel to a plane of the left edge 22 and the right edge 24 of the retainer body. The left face 32 and the right face 34 of the notch each may have a faceted portion 36 adjacent the bottom edge 20 of the retainer body to guide the fuel nozzle 28 into the notch 26. The faceted portion 36 may lie in a plane forming a 45° angle with a plane of the bottom edge 20.

The retainer body 12 is configured to engage a fairing 38 of a freight truck 40 within a fuel cutout 42 of the fairing. A body width 44 of the retainer body from the left edge 22 to the right edge 24 is configured to be greater than a cutout width 46 of the fuel cutout. A thickness 48 of the retainer body is configured to conform to an orthogonal distance between an inner face 50 of the fairing and a nozzle head 52 of the fuel nozzle when engaged within a fuel tank aperture 54 of the truck.

In use, once the fuel nozzle head 28 is inserted into the fuel tank aperture 54 of the truck, the retainer body 12 is engaged with the nozzle head 28 inserted into the notch 26 and pressed between the inner face 50 of the fairing and the nozzle head 52. The apparatus 10 thus retains the fuel nozzle 28 within the fuel tank aperture 54 while fueling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fuel nozzle retaining apparatus comprising:

a retainer body, the retainer body having a front side separated from a back side, a top edge separated from a bottom edge, and a left edge separated from a right edge; and the bottom edge having a notch, the notch having a left face, a top face, and a right face, the notch extending towards the top edge of the retainer body and being configured to receive a fuel nozzle of a gas pump;

wherein the retainer body is configured to engage a fairing of a freight truck within a fuel cutout of the fairing, a body width of the retainer body from the left edge to the right edge being greater than a cutout width of the fuel cutout, a thickness of the retainer body conforming to an orthogonal distance between an inner face of the fairing and a nozzle head of the fuel nozzle when engaged within a fuel tank aperture of the truck, the apparatus thus retaining the fuel nozzle within the fuel tank aperture.

2. The fuel nozzle retaining apparatus of claim 1 further comprising the top face of the notch being semicircular.

3. The fuel nozzle retaining apparatus of claim 1 further comprising the retainer body being rectangular excepting the notch.

4. The fuel nozzle retaining apparatus of claim 1 further comprising the left face and the right face of the notch being parallel and each lying in a plane parallel to a plane of the left edge and the right edge of the retainer body.

5. The fuel nozzle retaining apparatus of claim 4 further comprising each of the left face and the right face of the notch having a faceted portion adjacent the bottom edge of the retainer body.

6. The fuel nozzle retaining apparatus of claim 5 further comprising the faceted portion lying in a plane forming a 45° angle with a plane of the bottom edge.

7. The fuel nozzle retaining apparatus of claim 1 further comprising the retainer body having rounded corners.

8. A fuel nozzle retaining apparatus comprising:

a retainer body, the retainer body having a front side separated from a back side, a top edge separated from a bottom edge, and a left edge separated from a right edge, the retainer body having rounded corners; and the bottom edge having a notch, the notch having a left face, a top face, and a right face, the top face being semicircular, the retainer body being rectangular excepting the notch, the left face and the right face of the notch being parallel and each lying in a plane parallel to a plane of the left edge and the right edge of the retainer body, the left face and the right face of the notch having a faceted portion adjacent the bottom edge of the retainer body, the faceted portion lying in a plane forming a 45° angle with a plane of the bottom edge, the notch extending towards the top edge of the retainer body and being configured to receive a fuel nozzle of a gas pump;

wherein the retainer body is configured to engage a fairing of a freight truck within a fuel cutout of the fairing, a body width of the retainer body from the left edge to the right edge being greater than a cutout width of the fuel cutout, a thickness of the retainer body conforming to an orthogonal distance between an inner face of the fairing and a nozzle head of the fuel nozzle when engaged within a fuel tank aperture of the truck, the apparatus thus retaining the fuel nozzle within the fuel tank aperture.

* * * * *